US009192840B2

(12) United States Patent
Thomas

(10) Patent No.: US 9,192,840 B2
(45) Date of Patent: Nov. 24, 2015

(54) MARTIAL ARTS TRAINER

(71) Applicant: Stevon Thomas, La Mirada, CA (US)

(72) Inventor: Stevon Thomas, La Mirada, CA (US)

( * ) Notice: Subject to any disclaimer, the term of this patent is extended or adjusted under 35 U.S.C. 154(b) by 115 days.

(21) Appl. No.: 14/071,862

(22) Filed: Nov. 5, 2013

(65) Prior Publication Data

US 2015/0126339 A1 May 7, 2015

(51) Int. Cl.

| | |
|---|---|
| ***A63B 69/34*** | (2006.01) |
| ***A63B 69/22*** | (2006.01) |
| ***A63B 69/24*** | (2006.01) |
| ***A63B 69/00*** | (2006.01) |
| ***A63B 69/20*** | (2006.01) |

(52) U.S. Cl.

CPC ..... *A63B 69/004* (2013.01); *A63B 69/201* (2013.01); *A63B 69/206* (2013.01)

(58) Field of Classification Search

CPC ..... A63B 69/20; A63B 69/201; A63B 69/34; A63B 69/32; A63B 69/325

USPC ..... 482/83–90

See application file for complete search history.

(56) References Cited

U.S. PATENT DOCUMENTS

| | | | | | |
|---|---|---|---|---|---|
| 2,909,370 | A * | 10/1959 | Fortney | A63B 69/34 | 223/66 |
| 3,861,676 | A * | 1/1975 | Paul | A63B 69/34 | 482/83 |
| 4,491,315 | A * | 1/1985 | Dye | A63B 69/201 | 473/442 |
| 4,946,159 | A * | 8/1990 | Jones | A63B 69/004 | 473/441 |
| 5,046,724 | A * | 9/1991 | Sotomayer | A63B 69/20 | 482/90 |
| 5,111,771 | A * | 5/1992 | Mathews | A01K 15/025 | 119/708 |
| 5,281,191 | A * | 1/1994 | DeSousa | A63B 69/34 | 473/442 |
| 5,554,088 | A * | 9/1996 | Zlojutro | A63B 69/004 | 482/83 |
| 5,697,872 | A * | 12/1997 | Stronsick, Jr. | A63B 69/34 | 482/83 |
| 5,702,327 | A * | 12/1997 | Fullbright | A63B 69/20 | 473/441 |
| 5,902,217 | A * | 5/1999 | Schechner | A63B 69/201 | 482/83 |
| 6,063,011 | A * | 5/2000 | Pelchat | A63B 69/004 | 482/83 |
| 6,155,960 | A * | 12/2000 | Roberts | A63B 69/34 | 482/83 |
| 6,302,831 | B1 * | 10/2001 | Henry | A63B 69/004 | 482/83 |
| 6,432,027 | B1 * | 8/2002 | Haselrig | A63B 69/201 | 482/83 |
| 7,147,579 | B2 * | 12/2006 | Forrest | A63B 69/345 | 473/422 |
| 7,678,028 | B1 * | 3/2010 | Gore | A63B 69/004 | 482/86 |
| 2005/0167925 | A1 * | 8/2005 | Lewis | A63B 69/004 | 273/403 |
| 2007/0298911 | A1 * | 12/2007 | Bridge | A63B 69/0071 | 473/422 |

* cited by examiner

*Primary Examiner* — Stephen Crow
*Assistant Examiner* — Garrett Atkinson
(74) *Attorney, Agent, or Firm* — Clement Cheng

(57) ABSTRACT

A martial arts training device has a frame including a vertical post, and an impact absorbent material formed over the vertical post. The impact absorbent material is provided with an exterior striking surface. The vertical post supports the impact absorbent material to form a primary striking target. An upper armature member connects to the vertical post at an upper armature member upper end. The upper armature member extends horizontally from the vertical post and then extends downwardly at a diagonal angle. The upper armature member is connected to the central armature mount. A lower armature member connected to the central armature mount at a lower armature member upper end.

6 Claims, 5 Drawing Sheets

MARTIAL ARTS TRAINER

FIELD OF THE INVENTION

The present invention is in the field of martial arts trainers.

DISCUSSION OF RELATED ART

Martial arts, boxing and self defense practitioners have historically sought to enhance their martial skills by means of the utilization and development of specialized training equipment and devices, such devices allow practitioners to execute techniques, maneuvers, and motions delivered on and around various types of three dimensional objects that simulate the form, feel, resistance and or motion of human anatomy.

Heavy bags are generally vertical, longitudinal cylinders which are supported from a frame or from a ceiling. The bags are formed of a canvass, leather, or other suitable shell material which will stand up to punches, kicks and other athletic movement, as well as strikes from inanimate objects. The heavy bags are filled with a stuffing material which can vary. Normally cut up cloth, clothing or leather is used as the stuffing filler. However, it is not unusual to find heavy bags which are stuffed with sand filler, bead filler, foam, or other energy absorbent material which provide resistance, yet some flexibility to punches, kicks and other athletic movement. Typically the heavy bag shell is filled from the top with the stuffing or filler material and then drawn tight and secured to a support apparatus such as a chain, rope, ring or the like, which in turn is secured to a bracket eyebolt or frame which supports the heavy bag at a desired height above the floor.

The heavy bag is used by boxers, martial arts practitioners, and other athletes, and as such, the bag is struck with the hands, feet, and other anatomical parts such as the knees, elbows, and the like, as well as inanimate objects such as weapons or striking instruments. Over time the typical heavy bag experiences sagging in that under the influence of the athletic forces imposed on the outer shell and gravity, the stuffing or filling has a tendency to migrate downwardly toward the bottom of the bag. This presents a drawback to the athlete in training in that the density of the bag now varies such that punches and kicks delivered to one elevation of the bag may experience less or greater density than the same kicks applied to another level of the bag. This affects the athlete's training and may also contribute to injury since the athlete through experience expects to encounter a known resistance at different levels of the bag which the sagging of the stuffing and filler disrupts. It is therefore desirable to create a heavy bag that avoids the sagging or settling affect, and insures that the relative density and resistance experienced by the athlete in training remains the same over time. It is also desirable to provide a degree of rigidity to the bag to minimize side flexing or shape deformation due to repeated striking in one particular area of the bag. Applicant's spindle support acts as a spine to minimize these undesired effects.

Martial arts training devices are used, among other things, to help people develop a wide variety of striking skills. For example, coil bags or punching bags are used to help people develop punching and kicking skills. Such bags may be useful for developing technique, however, they are typically large and thus do not facilitate the development of striking accuracy. Target bags, or smaller punching bags, may be used to help people develop the accuracy of their punches and kicks. Such punching bags and target bags typically rest on the floor at a fixed height or are suspended from above at a fixed height. Often, trainees are forced to buy multiple punching bags and target bags to practice various techniques and hone accuracy.

For example, one punching bag might be used for kicking and another for punching, or multiple target bags might be used to practice kicking at different heights. The requirement for additional devices is undesirable. Further, such fixed devices are undesirable because they are static; not allowing the trainee to deviate from the positioning of the fixed targets.

One way trainees increase target variability is to use handheld targets. Handheld targets are pads or padded targets, which are held by a holder. Usually, they are smaller and are used to develop striking accuracy over a range of positions. The necessity of an additional holder, however, is undesirable because such a human assistant holder may not always be available.

While punching bags, target bags, and handheld targets are all valuable training tools, these traditional devices may require the trainee to purchase a number of bags or targets, or to train with a training partner to achieve desired results. Further, traditional devices only allow a trainee to "hit" or "miss" their target. They fail to simulate a "block" and thus similarly fail to teach the trainee how to strike through defenses.

Thus, there remains a need for a training device with at least one barrier between the trainee and the target to create a target zone while, at the same time, simulates blocking and teaches the trainee how to strike through defenses.

One example is a traditional device referred to as the wooden dummy being comprised of wooden slats that pass through a larger vertically oriented cylindrical section of wood which simulate a torso with arm and leg appendages. However the wooden striking surfaces are rigid and do not allow the practitioner to safely strike with greater forces. The appendages are set at a fixed height and thereby greatly limiting the vertical range of interaction.

Another example appears in U.S. Pat. No. 7,867,148 B2 by Tsakiris which discloses a heavy bag comprising a cylindrically shaped bag or pad with horizontally oriented armature members that are supported by a floor or suspended from ceiling. The primary benefits of this and similar devices are to provide a simulative multifunctional martial arts training device. However Punching and heavy bags only offer targets along a single cylindrical surface and thereby does not facilitate the execution of compound rebounding offensive and defensive actions along at least two adjacent points along the cylinders.

Another example of a prior art training aid appears in U.S. Pat. No. 6,872,171 by Haselrig which discloses a device comprising a generally cylindrical bag like object having one or more removable training appendage(s) or device(s). The primary benefits of this and similar devices being the fact that it incorporates the use of simulative objects which facilitate offensive and defensive training. However the appendages and objects are set at a fixed heights and thereby limit the height of the simulated attack or target.

Another example appears in U.S. Pat. No. 7,678,028 B1 by Gore which discloses a device comprising one or more horizontally oriented padded ring like barriers attached to a vertical post which may be anchored to the floor or ceiling. The primary benefits of this and similar devices are to provide a barrier between practitioner and Primary striking surface. However they require adjustment and reconfiguration of the device to allow access to the full target area of the inner striking surface, and does not ideally facilitate rebounding techniques.

Another example appears in U.S. 2008/0020910 A1 by Preciado which discloses a device comprising a vertically oriented rod with spring attached to a cylindrical shaped striking surface and perpendicularly oriented cushioned arm member. The primary benefits of this and similar devices are to provide a simulative torso with one or more arm, leg or weapon attached like appendages. However the fixed height of each appendage(s) limits the points at which compound attack simulation may occur without adjustment or reconfiguration.

Many martial arts training devices of various types (e.g., timing pads, punching bags, fight dummies, etc.) exist that enable a user to spar (practice striking skills associated with martial arts) or may simply be used as part of an exercise routine to expend energy. Among these, speed bags and body bags are especially well known.

For example, U.S. Pat. No. 4,653,746 by Brunier and U.S. Pat. No. 5,330,403 by Kuo both disclose punching devices that include a bag-like target area mounted to a tube and spring. The main advantage of these and similar inventions is to provide portability and adjustability to the basic punching bag. In that respect, both inventions do provide a convenient apparatus for striking. However, neither provides much opportunity to a user to anticipate counter movements or to practice evasion skills. Indeed, the return movement provided by each of these devices simply shortens the distance between the user and the target area without any simulation of a return blow.

More elaborate embodiments of the classic punching bag have evolved into "training dummies" and similar devices that feature anthropomorphic forms with specialized hitting surfaces and "arms" for simulating the delivery of a punch or the location of an opponent's hands. For example, U.S. Pat. No. 5,256,069 by Snowden, Jr. et al. discloses a boxing dummy apparatus featuring a torso, head, and appendages that are hit by a user. However, the torso and appendages of Snowden, Jr. et al.'s apparatus are static such that a user receives little if any stimulus to practice upper body evasion movements or footwork. Moreover, U.S. Pat. No. 5,052,683 by Wang et al. discloses a boxing training device with electronically controlled extendable arms.

While Wang et al.'s device may be suitable for its particular purpose, it is also relatively complicated, expensive, does not move toward an user to simulate a "charging counterattack" and does not respond to the force of a user's blow, but, rather, punches in a predetermined sequence according to a program stored in the device's memory. In the inventor's experience, a training device that "punches" according to a programmed sequence may not provide a good simulation for the typical "action and reaction" experienced when a blow is landed during a fight between human opponents. Thus, there remains a need in the art for an exercise device and sparring apparatus that mimics the "reaction punch" and counter movement of a sparring opponent, and that is less complex and economical compared with typical boxing dummies.

Another example appears in U.S. Pat. No. 5,899,835 by Puranda which discloses a multifunctional training device comprising a cylindrically shaped bag or pad with horizontally oriented armature members that are supported by a floor mounted spring and rod member. The primary benefits of this and similar devices are to provide a simulative multifunctional martial arts training device.

SUMMARY OF THE INVENTION

The present invention relates generally to sports and athletic exercise equipment, and more specifically but not by way of limitation to martial arts, boxing and self defense training devices which enhance and facilitate improvement in the practitioners efficiency in delivering offensive and defensive techniques and maneuvers delivered in rebounding and ricocheting combinations, at targets of various heights, widths and depths in relation to the practitioner.

A simulative sparring device facilitates ricocheting combinations of offensive & defensive techniques on four general quadrants. The martial arts trainer has: at least one upper and one lower vertically oriented armature member(s); at least one left armature member(s); and one right armature member(s) that are configured in a generally perpendicular orientation in relation to the upper and lower armature members, while being linked to a vertical support structure with weighted core, the arrangement of which creates opportunities for user interactions on the X, Y, and Z axis thereby forming at least one left angular sector and one right angular sector which facilitate(s) ambidextrous combination and ricochet training along the full height of the devices striking surfaces. The armature members are impact absorbent tubes being supported by and secured to a centrally located vertical support structure with weighted core. A link is attached to the upper end of the vertical support structure which serves as the point of attachment which secures the device to an overhead support structure. A larger vertically oriented impact absorbent, generally humanoid or cylindrically shaped striking surface is mounted onto the vertical support structure. The primary armature member extends horizontally beyond the upper outer edge of the striking surface and may extend down to a generally central point along the striking surface being mounted to the vertical support structure. The secondary armature member extends beyond the width and may extend beyond the length of the striking surface, wherein each armature member includes at least one training device receptacle which serve as mounting points for detachable training devices such as miniature reflexive focus bags and simulative weapons, the non armature side of the device may be utilized as a traditional heavy punching bag.

To isolate the practitioner from making direct contact with the devices' internal structures a padding can be added. The resulting secondary surface possesses a greater diameter. The larger diameter striking surface is the vertical column assembly having an internal support structure with weighted core. A vertically oriented rod is centered and attached to a circular plate at its lower end and being set at a right angle in relation to the rod. The lower rim of a cylindrical collar is then aligned and attached to the plate at a right angle. The cross trainer also possesses an armature whose junctions with the vertical column are made at the horizontal end of the upper quadrant being attached to top of the vertical post and the lower quadrants horizontal arm being attached to bottom of the base plate. These junctions maximize stability and transfer resistance to the upper and lower armature quadrants which facilitate the execution of offensive and defensive techniques and maneuvers. An internal supporting rod is formed to create both an upper and a lower armature quadrant while being set in parallel alignment in relation to the vertical column and extending the full length of the device. Each quadrant has linear and generally triangular or arc like sides with a common vertex which create a substantial area for the delivery of offensive and defensive techniques. The armature member also has at least 2 training device receptacles. The armature receptacles are positioned horizontally and are attached to the top and bottom of the armature assembly in a vertically linear orientation, parallel in relation to one another as illustrated in figures. The armature also serves as the mounting and support structure for the interchangeable training devices. The relationship and placement of the vertical column in relation to the position and angulations of the armature assembly promotes a free flowing training experience while making adjustment of the device unnecessary. Both the vertical column and armature assemblies are covered by one or more layers of impact absorbent materials.

Detachable training devices allow the practitioner to perform a variety of drills and exercises. Simply by removing and replacing the interchangeable and detachable armatures the practitioner has the means to quickly reconfigure and engage the device.

According to the preferred embodiment of this invention the present invention martial arts cross training device possesses multiple continuous vertically oriented cylindrical striking and blocking surfaces and has an internal support structure covered by one or more layers of impact absorbent materials. The armature assembly is suspended by an internal support structure set at a 90 degree or right angle in relation to the vertical column. The detachable training devices are comprised of armaments which may be formed into various forms such as but not limited to a model of a clenched fist, firearm or edged weapon and molded around a flexible and resilient tubing of ample resistance and rebounding qualities. In the case of the detachable training device being molded as a handgun, ends of the handgun can have openings where cords can attach to the openings to maintain a particular orientation.

The objectives of the present invention martial arts trainer are to provide martial arts cross training device for use in any training facility or home, which: permits use without the assistance of other persons; simulates incoming attacks of various vertical levels; promotes proper execution of martial techniques in combination; facilitate offensive and defensive activity on multiple parallel planes; provides a multitude of uninterrupted target areas on multiple planes. The simulative training device seeks to provide at least two generally vertically oriented cylinders one of which being smaller in diameter and more angular in nature, which facilitate the delivery of ambidextrous rebounding and ricocheting combinations of techniques such as punches, kicks, blocks, parries, strikes and counter strikes which may be executed along the full height of the device with no need for adjustment or manipulation of the device.

A summary of the claims is as follows: A martial arts training device has a frame including a vertical post, and an impact absorbent material formed over the vertical post. The impact absorbent material is provided with an exterior striking surface. The vertical post supports the impact absorbent material to form a primary striking target. An upper armature member connects to the vertical post at an upper armature member upper end. An armature member connects to the vertical post at two connection points which are namely a higher connection point and a lower connection point that can be rigid or semi-flexible connection. The upper armature member extends horizontally from the vertical post and then extends downwardly at a diagonal angle. The upper armature member is connected to the central armature mount. A lower armature member connected to the central armature mount at a lower armature member upper end.

The martial arts training device optionally includes a lower armature support that connects the lower armature member to the vertical post. A training device mount can be added for mounting detachable training devices which include reflexive speed targets, resistance bands or simulated weapons. A suspension link connected to the frame is attached to the upper end vertical support structure. A retaining tube fits around the vertical post. The retaining tube is held in place by the retaining cup. The retaining cup is attached to the base. The martial arts training device preferably includes a right armature member that extends horizontally from the vertical post and then extends downwardly at a diagonal angle. The right armature member has a right armature member impact absorbing cover. The martial arts training device preferably includes a left armature member that extends horizontally from the vertical post and then extends downwardly at a diagonal angle. The left armature member has a left armature member impact absorbing cover.

The callout list of elements can be a useful guide and parts list in referencing the elements of the drawings.

1 Upper Armature Member With Cover
2 Left Armature Member With Cover
3 Right Armature Member With Cover
4 Lower Armature Member With Cover
5 Vertical Post
6 Training Device Cable
7 First Upper Target
8 Central Target
9 Lower Armature Member Receptacle
10 Central Armature Mount Cover
11 Cross Training Device
12 Training Device Mount
13 Central Armature Mount
14 First Training Device Cable
15 Exterior Striking Surface
16 Lower Armature Member Bumper
17 Impact Absorbent Material
18 Retaining Tube
19 Training Device Mount
20 Training Device Mount
21 Overhead Suspension Link
22 Training Device Mount
23 Lower Armature Support
24 Training Device Mount
25 Retaining Tube Mount
26 Base Plate
42 Armature Left Side
43 Central Line Mount
44 Left Lying Mount
45 Bag Screen
46 Left Target
47 Armature Right Side
48 Mounting Post Central
49 Right Armature Mount
60 Left Armature Receptacle
61 Central Mounting Post Front
62 Right Armature Receptacle
63 Primary Armature Upper
64 Right Line Mount
51 Pedestal Mount Device
52 Armature Assembly
53 Pedestal Base
54 Armature Stabilizer
55 Primary Striking Surface

DETAILED DESCRIPTION OF THE PREFERRED EMBODIMENTS

A martial arts cross training device allows the practitioner to forcefully interact with at least two impact absorbent relatively cylindrically shaped vertically oriented striking surfaces. The first striking surface is angular and spanning the full length of a larger diameter cylinder or humanoid shaped striking surface. The device may also possess perpendicularly oriented armature member(s). This armature configuration forms upper left, lower left, upper right and lower right simulative and immersive training sectors that simulate a wide variety of offensive and defensive attacks and targets which facilitate improvement in the practitioners efficiency in the execution of a offensive and defensive actions such as but not limited to rebounding and ricocheting combinations of punches, parties, blocks, kicks, strikes and counter strikes which may be delivered to parallel points along at least two vertically oriented cylinders which span full height of the device.

The device is supported by a pedestal and base member whose inner void which may be filled with an appropriate weighting material(s) such as but not limited to sand, water or gravel. The base and pedestal member rests on the floor and provides resistance and stability for the device.

Optionally, the vertical support structure and at least the upper and lower armature members can be a single continuous integrally formed assembly.

Figure 1:
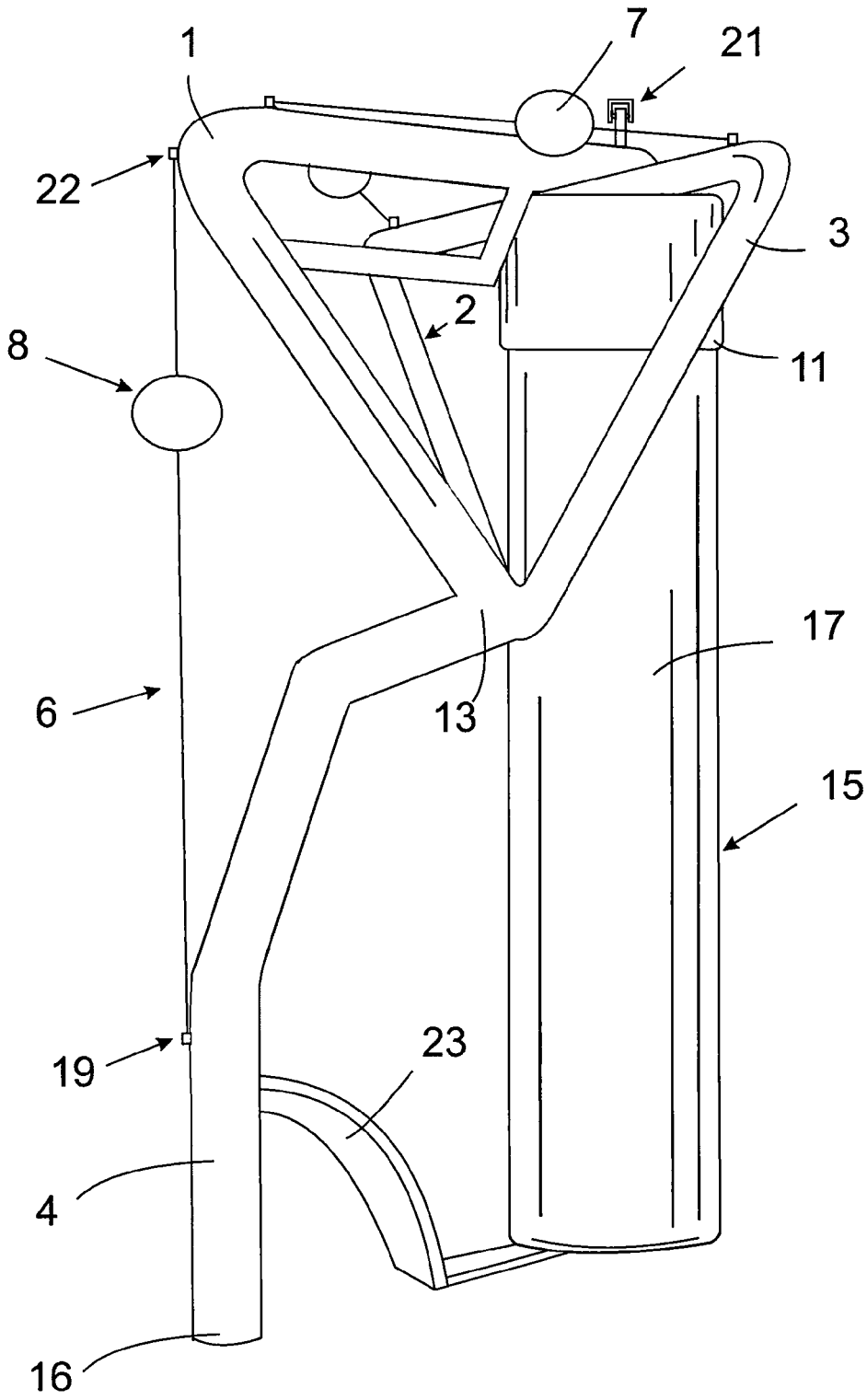
FIG. 1 is a perspective side view of the martial arts training device constructed in accordance with the preferred embodiment of the present invention, with interchangeable and detachable training devices such as reflexive targets.
Figure 2:
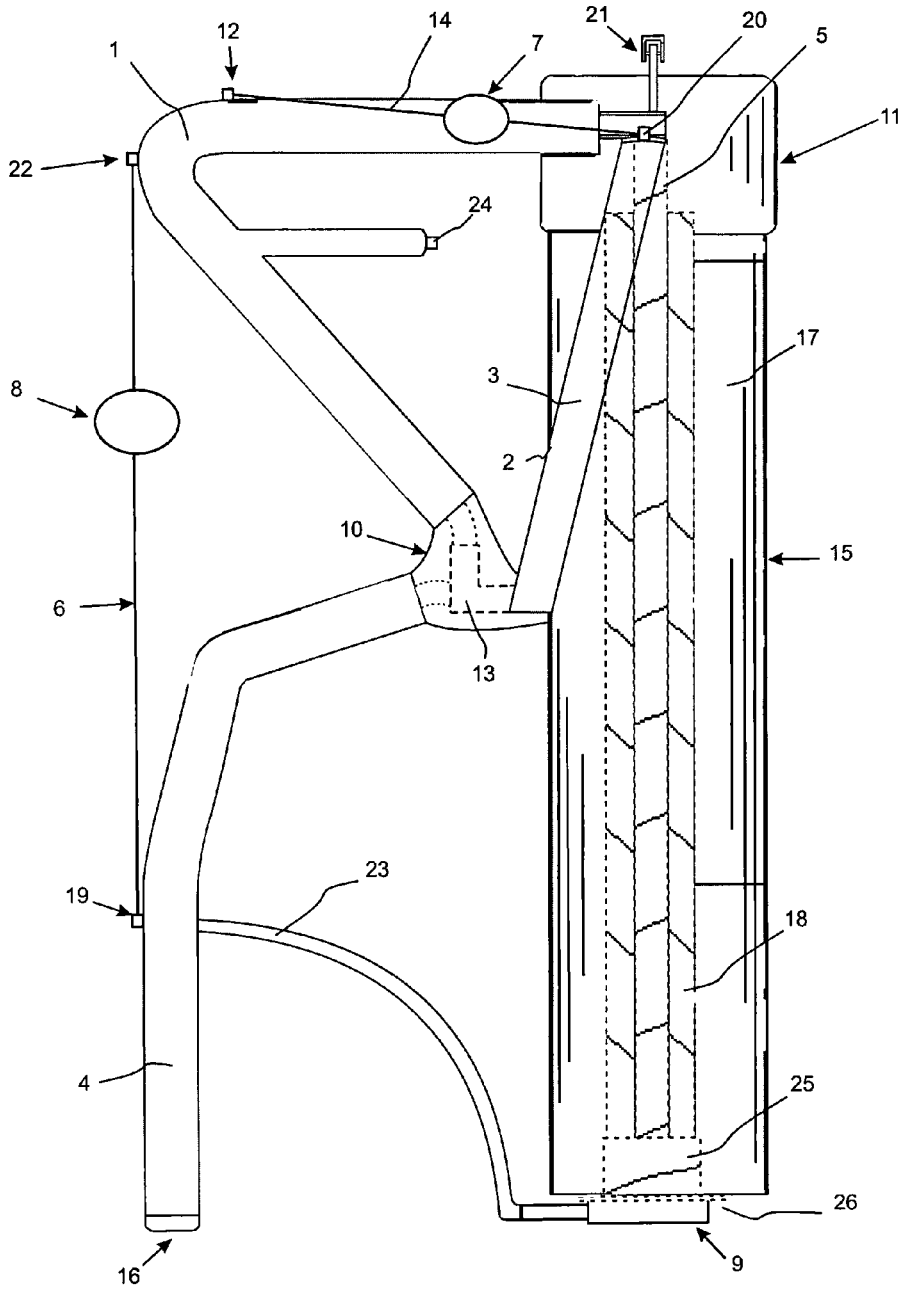
FIG. 2 is a cross section side view of the martial arts training device in cross-section.

As seen in FIG. 2, a cross section side view of the martial cross training device 11 generally shows an internal support structure which includes a lower armature member receptacle 9, a base plate 26, a retaining tube mount 25, a retaining tube 18, a vertical post 5, and an overhead suspension link 21 that are rigidly connected together as a frame. The vertically oriented striking surface 15, upper armature member 1, or lower armature member 4, and left armature member 3*b*. with central mount 13, and right armature member 3 are attached to the rigidly connected frame.

As seen in FIG. 2, the device 11, has a centrally located vertical support structure, including vertically oriented rod 5, being supported by and attached to the base plate 26 at the lower end of the vertically oriented rod. A larger diameter cylindrical retaining tube 18 surrounds the vertical post 5, and is held in place by the cylindrical retaining tube mount 25, which is attached to the top side of base plate 26. The void created between the vertical post 5 and cylindrical retaining tube 18 may be filled with weighting material such as but not limited to concrete or sand or other suitable granular materials may be utilized to provide weight and resistance to the device 11.

The device 11 may be suspended by a linkage 21, on the upper end of the vertical post 5. The upper end of the upper armature member 1, is attached to the upper end of the vertical post 5. The upper armature member 1 has an upper armature member cover. The upper armature member 1, is attached to the upper end of the central armature mount 13 at a lower end of the upper armature member.

The lower armature member 4, is attached to a lower section of the central armature mount 13. The central armature mount can receive the upper end of lower armature member 4 as well as the lower ends of the three upper armature members such that the central armature mount 13 connects four different members together to form a single rigid frame. The three upper armature members include the left armature member with cover 2, armature member with cover 3, and the upper armature member with cover 1. The left armature member extends leftward from the upper portion of the vertical post 5 and then downward in a diagonal fashion to the central armature mount 13. The right armature member extends rightward from the upper portion of the vertical post 5 and then downward in a diagonal fashion to the central armature mount 13. The upper armature member 1 is oriented toward the user. Therefore, the upper armature member 1 is 90° to the right of the left armature member, and 90° to the left of the right armature member. The left armature member is 180° in relation to the right armature member. The left and right armature member has a padded cover that can be made of foam tubing.

The upper end of the left armature member 2, is preferably attached to the upper portion of the vertical post 5. The lower end of the left armature member 2, further attaches to the left portion of the central armature mount 13. The upper end of the right armature member 3, attaches to the vertical post 5, and the lower portion of the right armature member 3, attaches to the right portion if the central armature mount 13. A lower armature member 4, is attached at its upper end to the lower portion of the central armature mount 13, and is also attached to a lower armature support 23, as well as being further attached to the lower armature mount 9, located at the underside of base plate 26. The lower armature support can be arc shaped.

Figure 3:
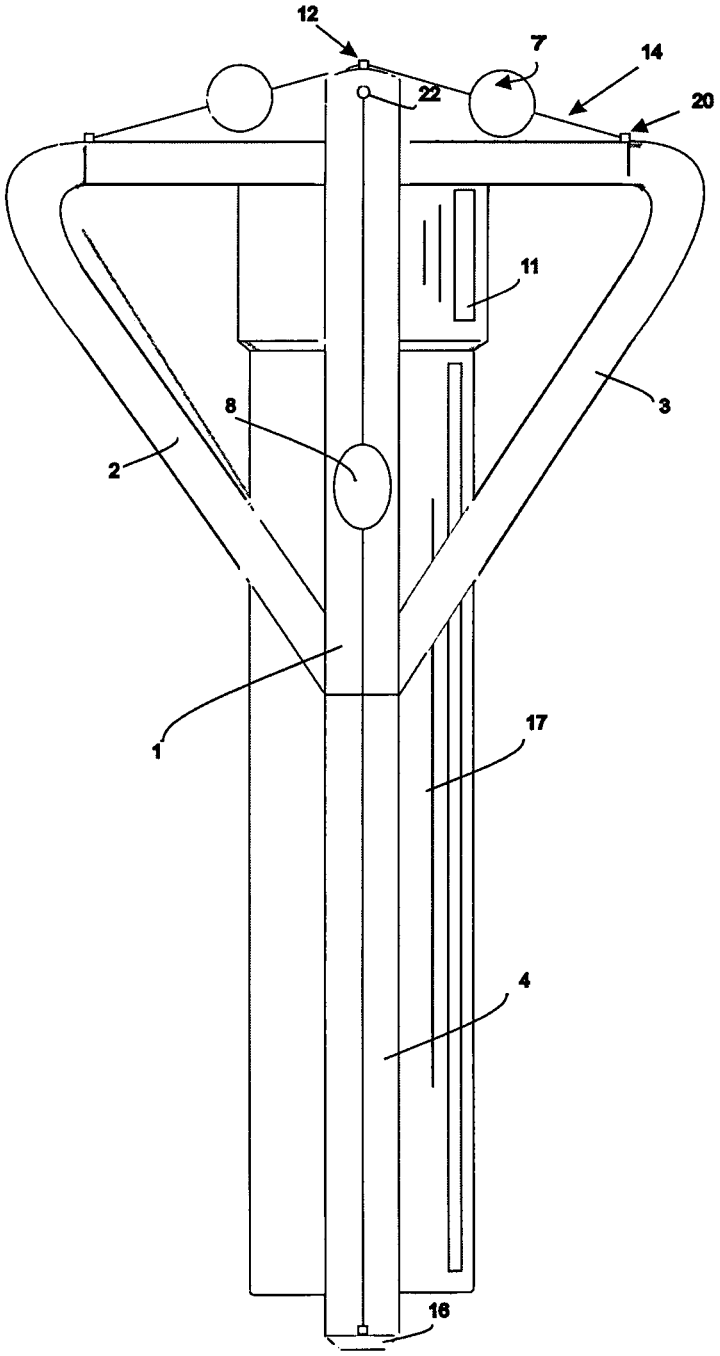
FIG. 3 is a front view of the martial arts training device.

As seen in FIG. 3, a network of impact absorbent covers are being positioned over the entire external periphery of the device which creates an impact absorbent and protective barrier between the internal support structure. The impact absorbent cover is a padding that also serves as the devices striking surface. The covering may be molded, stitched by sewing, welded, cemented or held together by other means at the junctures where the covering ends meet.

As seen in FIG. 2, the linkage suspension 21 is attached to the upper end of the vertically oriented core with rod which serves as the overhead suspension point of the device.

Figure 4:
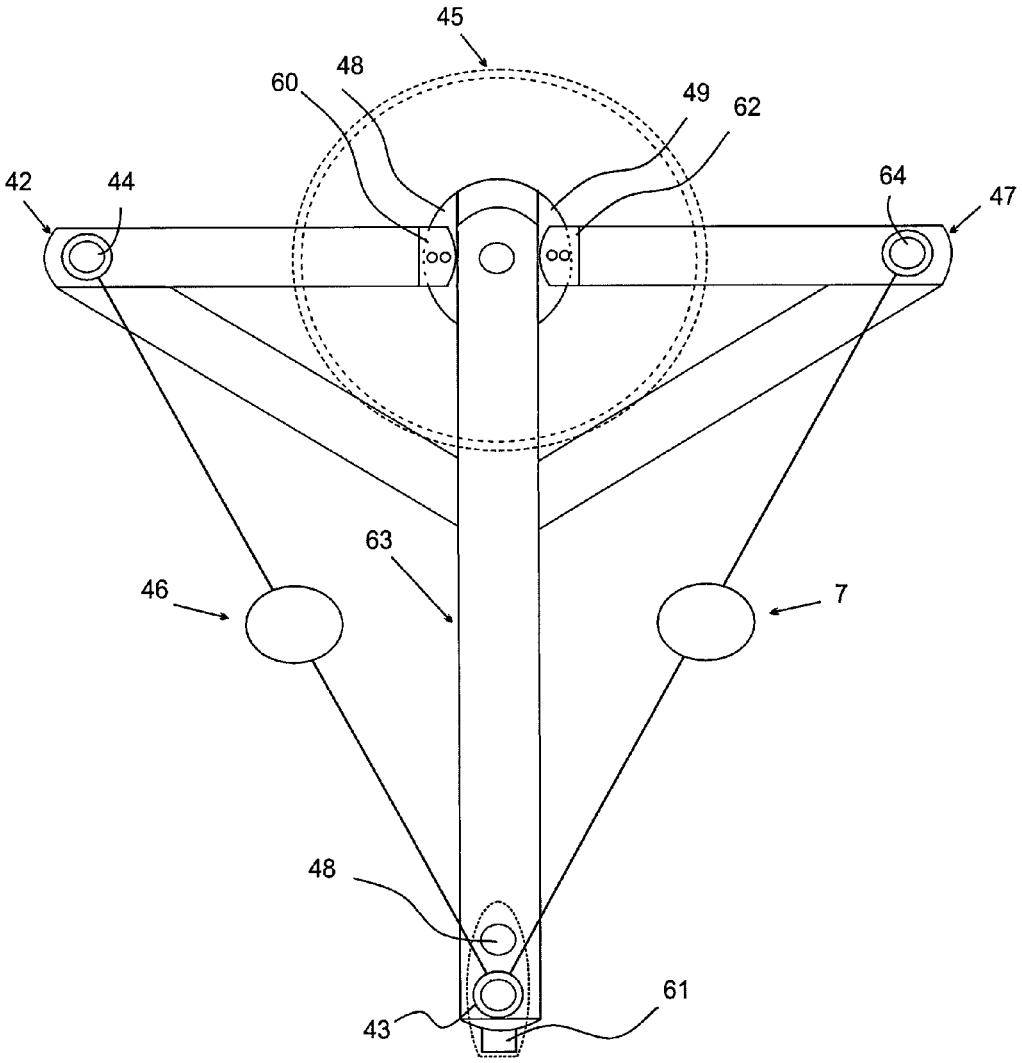
FIG. 4 is a top view of the martial arts training device.

As seen in FIG. 4, each armature segment may include at least one device mount which secures the various detachable training devices.

In FIG. 4, a detachable training device is displayed. The training device can be attached to the ceiling such as by a cable and then detached.

Figure 5:
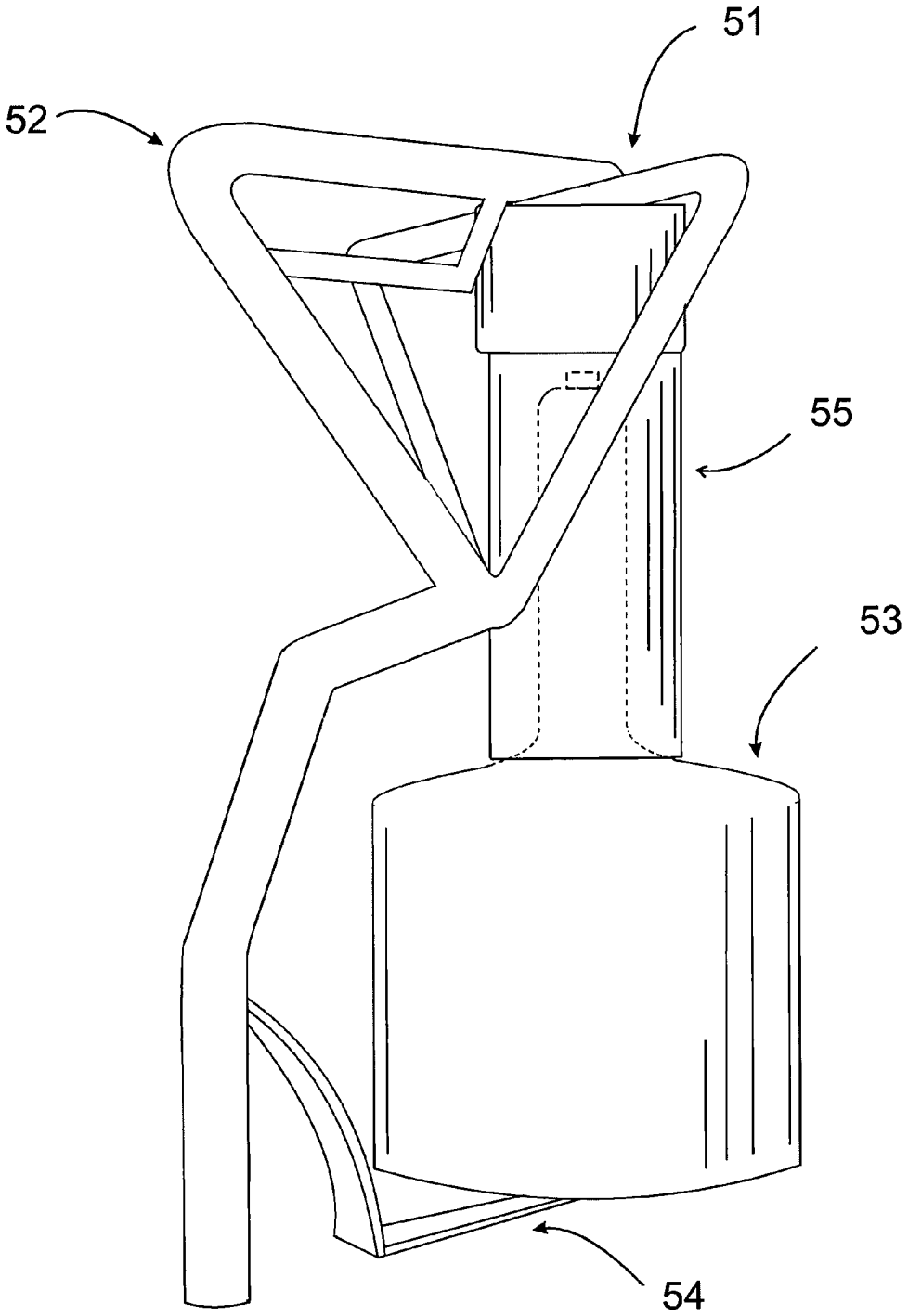
FIG. 5 is a perspective side view of the pedestal mount version of the device.

As seen in FIG. 5, the pedestal mount device 51 has a pedestal base 53. The pedestal base is broad and of larger diameter and supports the pedestal mount device 51 enough so that the pedestal mount device 51 can stand on the floor and not tip over during use. The armature assembly is the same as discussed above. The pedestal mount armature assembly 52, is connected to the frame as usual. The pedestal base 53 has been enlarged in diameter such that it is larger than the primary striking surface 55. The primary striking surface 55 is connected above the pedestal base 53.

A variety of different materials can be used for the striking surface. Any type of natural or synthetic material can be used for surrounding the cylindrical periphery of the device which may be stitched, electronically welded, cemented or held together by other means at the junctures where the covering ends meet. Before closing the external covering on the primary striking surface, the bad can be filled with or stuffed with a combination of one or more layers of suitable impact absorbent materials. Such impact absorbent materials include but are not limited to synthetic and or natural foam, rubber, silicon, cotton and wool. All such materials are within the scope and intent of this invention. Optionally, some striking surfaces can be left bare according to traditional surfaces of wood practice targets.

The striking surface is supported via a support structure made as the vertical column shown consisting of a base plate upon which a vertically oriented rod is attached to the center portion of the base plate. The support structure also has four armature receptacles set at a 90 degree or right angle in relation to the vertical column. The armature receptacles are positioned in a horizontal fashion and are attached to the vertical column in a linear fashion set at various heights along the vertically oriented pole.

The impact absorbent armature assembly includes an upper section of the primary armature member being supported by and attached to the upper end of the centrally located vertically oriented rod, as well as a lower primary armature member being attached to the lower end of the centrally located rod within the core. The primary armature assembly extends horizontally beyond the outer edge of the striking surface and extends beyond the full vertical height of the striking surface. The armature assembly also facilitates the integration of resistance training power bands.

Any of the members can be made as adjustable telescoping rods that can be made with each rod of a diameter which allows the vertical column to receive and support the armature assemblies being made of smaller diameter rod in relation to the armature receptacles for length adjustment. The armature assembly can be fixed at a right angle in relation to the vertical striking surface and extend beyond the exterior of the vertical striking surface of the bag. The armatures also possess an angled bend which allows the opposite end of the armature to also pass through the striking surface of the device at a different level which creates dual mounting points for each armature. A plurality of vertically set rod like structures set at a right angle in relation to the vertical bag each being removable and inserted at both ends of the angled rod.

The non armature side of the device may be utilized as a standard heavy bag. One or more armature such as two, three or four armatures can be used.

Assembly

Assembly instructions for the device 11 can be as follows: A user may place the base plate 26 on the floor. The base plate 26 can be formed as part of the lower armature member receptacle 9. The lower armature member receptacle 9 is then connected to the lower armature support 23. The base plate 26 or the lower armature member receptacle 9 can be bolted to a concrete floor. The retaining tube mount receives the vertical post 5. The retaining tube 18 can be fit over the vertical post 5. The retaining tube 18 can be made of a rigid material such as metal, or can be a soft material such as foam padding, however in any case it has a small enough diameter to snugly fit within the retaining tube mount 25. Instead of bolts and the device to the floor, the device can be hung from an overhead suspension link 21. The overhead suspension link 21 can be part of the vertical post 5, or can be welded to the vertical post 5.

The central armature mount 13 can be connected to the lower armature member. It is preferred to put the armature cover over the armature before connecting to the central armature mount 13. The lower armature member 4 may have a lower armature member bumper 16 formed as a plastic cap that is inserted into a tubular portion of the lower armature member 4. The lower armature support 23 is then connected to the lower armature member 4 such as by a bolt. The central armature mount 13 also has a central armature mount cover 10 which can be installed after installation of the upper armature members.

The upper armature member 1 also called the central armature member is connected to the vertical post 5. The vertical post 5 can be made as a rod or tube. The upper end of the vertical post 5 is connected to the upper armature member 1. The lower end of the upper armature member is then connected to the central armature mount 13. Similarly, the left armature member 2 and the right armature member 3 are connected to the central armature mount 13.

The connections for the pedestal base 53 are the same. The pedestal mount device 51 receives a pedestal base that can fit over the primary striking surface 55, or can be made separately from the primary striking surface 55. The armature stabilizer 54 can be a lower armature support 23. The armature assembly 52 can be installed as described above.

The speed targets can then be set up. The armature left side 42 is opposite from the armature right side 47. The armature left side can have a left line mount 44 and the armature right side 47 can have a right line mount 64. There may also be a central line mount 43 that can receive a training device cable 6. The cable 6 can be mounted to any of the line mounts. The line mounts can be formed as mounting posts that protrude from a top surface of the armature assembly 52.

The armature assembly 52 has a left armature receptacle 60 that receives the left armature, and a right armature receptacle 62 that receives the right armature. The right armature mount 49 can be formed as a right armature receptacle 62.

A first upper target 7 can be connected on the right side on a line such as an elastic cord that is held between the right line mount and the central line mount. Similarly, a left target 46 can be connected to a left elastic cord that is held between the left line mount and the central line mount.

The upper armature member with cover 1 may have a central mounting post front 61. A pair of central mounting posts 48 can be formed on the upper armature member which is the primary armature. The primary armature has a primary armature upper 63 from which the central mounting posts 48 can protrude. Thus, training device mounts 12, 19, 20, 22 can hold a variety of different targets such as a first upper target 7, a left target 46, and a central target 8 for a total of three targets.

The bag screen 45 can fit over the main bag.

The impact absorbent material 17 is fit around the retaining tube 18. The exterior striking surface 15 is fit over the impact absorbent material 17 and can be zippered closed.

Certain modifications and improvements will occur to those skilled in the art upon a reading of the foregoing description. It should be understood that all such modifications and improvements have been deleted herein for the sake of conciseness and readability but are properly within the scope. The embodiments of this invention which are described above may be embraced in other specific forms without departing from the essential characteristics of the invention. The described embodiments are, therefore, to be considered in all respects as illustrative and not restrictive.

The invention claimed is:

1. A martial arts training device comprising a frame comprising:

a. a vertical post;

b. an impact absorbent material formed over the vertical post, wherein the impact absorbent material is provided with an exterior striking surface, wherein the vertical post supports the impact absorbent material to form a primary striking target;

c. an impact absorbent armature assembly connecting to the vertical post at two connection points which are namely a higher connection point extending downwardly to a lower connection point, wherein the impact absorbent armature assembly extends along a full height of the vertical post to provide an obstruction along the full height of the vertical post in front of the vertical post;

d. an upper armature member connecting to the vertical post at an upper armature member upper end, wherein the upper armature member extends horizontally from the vertical post and then extends downwardly at a diagonal angle, wherein the upper armature member is a part of the impact absorbent armature assembly;

e. a central armature mount, wherein the upper armature member is connected to the central armature mount at a lower end of the upper armature member, wherein the central armature mount is a part of the impact absorbent armature assembly;

f. a lower armature member connected to the central armature mount at a lower armature member upper end, wherein the lower armature member is a part of the impact absorbent armature assembly; and g. a lower armature support that connects the lower armature member to the vertical post.

2. The martial arts training device according to claim 1, further comprising:

a. a right armature member that extends horizontally from the vertical post and then extends downwardly at a diagonal angle and also connects to the central armature mount, wherein the right armature member has a right armature member impact absorbing cover; and b. a left armature member that extends horizontally from the vertical post and then extends downwardly at a diagonal angle and also connects to the central armature mount, wherein the left armature member has a left armature member impact absorbing cover.

3. The martial arts training device according to claim 2, further comprising a retaining tube fitting around the vertical post, wherein the retaining tube is held in place by a retaining cup, wherein the retaining cup is attached to a base, wherein the vertical post is mounted to the base.

4. The martial arts training device of claim 2, further comprising a training device mount for mounting detachable training devices which include: reflexive speed targets, resistance bands or simulated weapons.

5. The martial arts training device according to claim 2, further including a suspension link connected to the frame and attached to an upper end vertical support structure.

6. The martial arts training device according to claim 2, wherein the retaining tube is held in place by a retaining cup, wherein the retaining cup is attached to a base, wherein the vertical post is mounted to the base, further comprising a training device mount for mounting detachable training devices which include: reflexive speed targets, resistance bands or simulated weapons, further including a suspension link connected to the frame is attached to an upper end vertical support structure, further comprising a lower armature support that connects the lower armature member to the vertical post.

* * * * *